US008859483B2

(12) United States Patent
Shell et al.

(10) Patent No.: US 8,859,483 B2
(45) **Date of Patent: *Oct. 14, 2014**

(54) CLEANING COMPOSITIONS

(71) Applicant: Agaia International, Inc., Fort Lauderdale, FL (US)

(72) Inventors: Christopher A. Shell, Broken Arrow, OK (US); Benjamin P. Shell, Fort Lauderdale, FL (US)

(73) Assignee: Agaia International, Inc., Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/869,492

(22) Filed: Apr. 24, 2013

(65) Prior Publication Data

US 2014/0148373 A1 May 29, 2014

Related U.S. Application Data

(63) Continuation of application No. 13/464,520, filed on May 4, 2012, now Pat. No. 8,455,426.

(51) Int. Cl.

| | |
|---|---|
| ***C11D 3/382*** | (2006.01) |
| ***C11D 1/66*** | (2006.01) |
| ***C11D 3/04*** | (2006.01) |
| ***C11D 3/20*** | (2006.01) |
| ***C11D 3/10*** | (2006.01) |
| ***C11D 1/825*** | (2006.01) |

(52) U.S. Cl.

CPC ..... *C11D 3/2093* (2013.01); *C11D 3/382* (2013.01); *C11D 1/662* (2013.01); *C11D 3/044* (2013.01); *C11D 3/10* (2013.01); *C11D 1/825* (2013.01)

USPC ..... 510/470; 510/435; 510/437; 510/474

(58) Field of Classification Search

USPC ..... 510/435, 437, 470, 474

See application file for complete search history.

(56) References Cited

U.S. PATENT DOCUMENTS

| | | | | |
|---|---|---|---|---|
| 5,266,690 | A | 11/1993 | McCurry, Jr. et al. | |
| 5,449,763 | A | 9/1995 | Wulff et al. | |
| 5,633,359 | A | 5/1997 | Beaulieu | |
| 5,877,133 | A | 3/1999 | Good | |
| 6,066,614 | A | 5/2000 | Orlandini et al. | |
| 6,180,592 | B1 | 1/2001 | Smith et al. | |
| 6,407,051 | B1 | 6/2002 | Smith et al. | |
| 6,653,272 | B1 | 11/2003 | Uyama | |
| 8,053,400 | B2 | 11/2011 | Dong et al. | |
| 8,455,426 | B1 * | 6/2013 | Shell et al. | 510/474 |
| 2005/0227899 | A1 | 10/2005 | Shamayeli | |
| 2009/0318321 | A1 * | 12/2009 | Hood et al. | 510/106 |
| 2010/0093581 | A1 | 4/2010 | Winston et al. | |
| 2012/0128614 | A1 * | 5/2012 | Rieth et al. | 424/70.1 |

FOREIGN PATENT DOCUMENTS

| | | |
|---|---|---|
| WO | WO9531525 | 11/1995 |
| WO | WO2010138907 | 12/2010 |

OTHER PUBLICATIONS

PCT/US2013/36428; International Search Report and Written Opinion; dated Jul. 25, 2013; 9 pages.
BASF Glucopon® 215 UP Product Datasheet.
BASF Glucopon® 425 N Product Datasheet.

* cited by examiner

*Primary Examiner* — Brian P Mruk
(74) *Attorney, Agent, or Firm* — King & Partners, PLC

(57) ABSTRACT

A liquid cleaning composition containing alkyl polyglycoside surfactants, alkyl esters derived from vegetable oil, water and a sodium-containing base provides excellent cleaning soil removal capabilities. The carbon materials from which it is manufactured are all renewable, and the composition is readily biodegradable.

18 Claims, No Drawings

CLEANING COMPOSITIONS

This application is a continuation of U.S. Application Ser. No. 13/464,520, filed May 4, 2012, now U.S. Pat. No. 8,455,426 B1, entitled "Cleaning Compositions," which is hereby incorporated herein by reference in its entirety, including all references cited therein.

BACKGROUND OF THE INVENTIVE CONCEPTS

1. Field of the Inventive Concepts

The inventive concepts disclosed and claimed herein relate to cleaning compositions and, more particularly, but not by way of limitation, to non-toxic, liquid cleaning compositions having environmental benefits and exhibiting effective cleaning performance.

2. Brief Description of Related Art

Efficient cleaning performance and "green" manufacturing methods are two major concerns of consumers in choosing a cleaning composition. Not all kinds of soils can be efficiently removed using conventional detergents and cleaning compositions. The need to remove oily stains using a water-based detergent has led to use of cleaning additives and soil-suspending polymers that are not completely biodegradable. Surfactants, builders, bleaches and polymers used in detergent compositions often present environmental concerns. For example, some surfactants and bleach activators are known not to be completely biodegradable, and builders such as phosphate builders are known to cause eutrophication (hypertrophication) of rivers and lakes.

These conventional detergent components have been added to the detergent compositions for many years. Despite the significant research done in this area, there remains a need for improvements in the cleaning efficiency of cleaning compositions. Additionally, with the presently increasing environmental awareness and concerns, and with the public desire to use "green" products, there is a need for efficient, natural and environmentally friendly cleaning compositions.

SUMMARY OF THE INVENTIVE CONCEPTS

The inventive concepts disclosed and claimed herein generally relate to cleaning compositions, and particularly to "green", renewable and biodegradable cleaning compositions and methods of making the cleaning compositions. Such a liquid cleaning composition contains alkyl polyglycoside surfactants, one or more alkyl esters derived from vegetable oil, water, and a sodium-containing base. The composition provides excellent cleaning and soil removal.

In one embodiment, the liquid cleaning composition includes from 20% to 60% by weight, of alkyl polyglycosides. The alkyl polyglycosides containing at least one short chain alkyl polyglycoside having a chain length of from 8 to 10 carbon atoms, and at least one long chain alkyl polyglycoside having a chain length of from 12 to 14 carbon atoms. About 1% to 15% by weight of an alkyl ester derived from vegetable oil is present as well as from 1% to 15% by weight of a sodium-containing base. The sodium-containing base can be sodium hydroxide and/or sodium carbonate. The balance of the liquid cleaning composition is water and optionally other adjunct ingredients.

DETAILED DESCRIPTION OF THE EXEMPLARY EMBODIMENTS

Before explaining at least one embodiment of the inventive concepts disclosed herein in detail, it is to be understood that the inventive concepts are not limited in their application to the details of construction, experiments, exemplary data, and/or the arrangement of the components set forth in the following description, or illustrated in the drawings. The presently disclosed and claimed inventive concepts are capable of other embodiments or of being practiced or carried out in various ways. Also, it is to be understood that the phraseology and terminology employed herein is for purpose of description only and should not be regarded as limiting in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

The presently claimed and disclosed inventive concepts provide a liquid cleaning composition having a nonionic surfactant system, an alkyl soyate solvent, a sodium-containing base, and water. In one embodiment the nonionic surfactant system comprises alkyl mono- and polyglycoside surfactant having the general formula: $RO(G)_n$ wherein R is a monovalent organic radical containing from about one to about 30 carbon atoms. Examples of such monovalent saturated aliphatic, unsaturated aliphatic or aromatic radicals include but are not limited to alkyl, hydroxyalkyl, alkenyl, hydroxyalkenyl, aryl, alkylaryl, hydroxyalkylaryl, arylalkyl, alkenylaryl, arylalkenyl, and the like. In one embodiment, R represents monovalent, saturated aliphatic groups which contain from 8 to about 16 carbon atoms. G represents a moiety derived from a reducing saccharide containing 5 or 6 carbon atoms. The "n" represents the number of reducing saccharide moieties, or degree of polymerization, and has a value of from 1 (monoglycoside) to about 20. In one embodiment, n averages from 1 to about 5. As used herein, and in the appended claims, the term "alkyl polyglycosides" includes alkyl monoglycosides as well as alkyl polyglycosides.

The alkyl polyglycoside can be formed using reducing saccharides such as arabinose, xylose, glucose, galactose and the like. Glycosidation by the Fischer process is the oldest known process for making alkyl glycosides by reacting saccharides with alcohols in the presence of strong acids. Other processes have been developed including base-catalyzed alkylation and enzymatically catalyzed syntheses if alkyl glucosides. In one embodiment, the raw material is sugar-derived (glucose and sucrose) and the resulting surfactant is an alkyl polyglucoside. Such surfactants have a hydrophobic fatty alcohol portion and a hydrophilic glucoside portion. Alkyl polyglycoside and alkyl polyglucoside are available commercially from, for example, Cognis, Akzo Nobel, and Uniqema.

In order for the liquid cleaning composition to remove a variety of different hydrophobic oils and greases, the polyglycosides have both short and long alkyl chain lengths. This can be accomplished by mixing two or more nonionic surfactant products having different average alkyl chain lengths. For example, a suitable surfactant mixture can contain polyglycosides having alkyl chain length of 8 carbon atoms and a second polyglycoside having alkyl chain length of 14 carbon atoms. In one embodiment, the nonionic surfactant system is mixture of polyglycosides having alkyl chain lengths of from about 8 carbon atoms up to about 14 carbon atoms. Commercially available polyglycoside surfactant products are often mixtures of "naturally derived" surfactants already having a mixed range of alkyl chain lengths. Thus, in one embodiment, the nonionic surfactant system is a combination of a short chain alkyl polyglycoside surfactant mixture having alkyl chain lengths of from about 8 to about 10 carbon atoms, and a longer chain alkyl polyglycoside surfactant mixture having alkyl chain lengths up to 14 or 16 carbon atoms.

It has been discovered that a mixture of long and short chain length alkyl polyglycosides offers significant soil cleaning performance improvements compared to a single chain length alkyl polyglycoside. While not wishing to be bound by any particular theory, it is believed that the soil removal kinetics are significantly superior for the shorter $C_8$ to $C_{10}$ chain length alkyl polyglycosides compared to the longer chain alkyl polyglucosides. However, the longer carbon chain length alkyl polyglycosides provide better removal of oily soils. The combination of polyglycosides having shorter and longer alkyl chain lengths appears to provide synergistic results.

The addition of a solvent to the liquid cleaning composition improves the cleaning efficiency of the composition, presumably by acting as a solvent or softener for hydrophobic oily or greasy soils. Suitable solvents having "green" properties include alkylated vegetable oils. Nonlimiting examples of suitable vegetable oils include castor oil, coconut oil, corn oil, cottonseed oil, hemp oil, mustard oil, olive oil, palm oil, peanut oil, rapeseed oil (canola), rice bran oil, safflower oil, sesame oil, soybean oil, and sunflower seed oil.

Oils and fats are often distinguished based on their melting point; oils are liquid at room temperature, and fats are solid. The term "vegetable oil," as used herein and in the appended claims, refers to any oil or fat obtained from plants, and that is liquid at room temperature in its alkylated form.

In one embodiment, the alkylated vegetable oil is an alkyl soyate. Suitable alkyl soyate solvents include, but are not limited to, methyl soyate, ethyl soyate and propyl soyate. An alkyl soyate is an alkyl ester derived from soybean oil. Soybean oil is a mixture of long chain saturated and unsaturated acids such as palmitic, stearic, oleic, and linoleic acids. Hence, the alkyl soyate includes, for instance, the methyl or ethyl ester of R—COOH.

In one embodiment, the alkyl soyate solvent is methyl soyate. Methyl soyate is produced by reacting soybean oil and methanol. It is a commonly used biodiesel in the United States. Although the term methyl soyate is sometimes used interchangeably with biodiesel, "biodiesel" refers to the alkyl monoester of any vegetable oil or animal fat. For example, rapeseed oil is commonly used in Europe to prepare biodiesel.

A sodium base is used to increase the pH of the cleaning composition. It has been surprisingly discovered that addition of sufficient quantities of a sodium base significantly improves the cleaning performance of the cleaning composition. Suitable examples of a sodium base include sodium carbonate and sodium hydroxide. While it is not necessary to include a sodium base to obtain satisfactory soil removal, it was found that soil removal was abruptly and unexpectedly improved upon sufficient addition of the sodium base.

The cleaning composition may comprise a number of optional ingredients such as bleaching agents, fatty acids, radical scavengers, antimicrobial compounds, builders, chelants, buffers, bactericides, solvents, enzymes, hydrotropes, colorants, bleach activators, soil suspenders, dye transfer agents, brighteners, anti dusting agents, dispersants, dye transfer inhibitors, pigments, perfumes and dyes.

Because the alkyl polyglycosides and alkylated vegetable oils are liquid, the liquid cleaning composition can be prepared with very little water. For example, a liquid cleaning composition can be prepared using only sufficient water to dissolve the sodium-containing base. In one embodiment, a liquid cleaning composition comprises from 20% to 60% by weight, of alkyl polyglucosides, 1% to 15% by weight of an alkylated vegetable oil and from 1% to 15% by weight of a sodium base, with the balance water and other adjunct ingredients.

In one embodiment, the weight ratio of alkylated vegetable oil to alkyl polyglucosides is from about 3:100 to 33:100, while the weight ratio of sodium carbonate to alkylpolyglucosides is from about 5:100 to 50:100.

A method of making the above-described cleaning composition includes mixing a sodium-containing base, such as sodium carbonate or sodium hydroxide with water. The resulting alkaline aqueous solution is then mixed with alkyl polyglucosides and an alkylated vegetable oil. Mixing methods and devices are well known to those skilled in the art.

The cleaning compositions described and claimed herein may be used for a variety of cleaning purposes such as cleaning glass and windows, cleaning hard surfaces, and cleaning laundry. A variety of suitable packaging can be used such as bottles and spray type dispensers known to those skilled in the art.

The alkyl polyglycosides and the alkylated vegetable oils are "green," renewable ingredients. Additionally, and as understood by those skilled in the art, such green ingredients are biodegradable leaving no harmful contaminants in the environment.

In order to further illustrate the present invention, the following examples are given. However, it is to be understood that the examples are for illustrative purposes only and are not to be construed as limiting the scope of the invention.

Examples

Using a small-scale laboratory mixer, cleaning compositions were prepared and tested for cleaning efficiency. Caprylyl/decyl glucoside (GLUCOPON® 215), purchased from Cognis and designated as APG 215, was an aqueous solution having 35 to 38% water and the remainder alkyl polyglucosides based on a C8-C10 natural fatty alcohols. Caprylyl/miristyl glucoside (GLUCOPON® 425N), also purchased from Cognis and designated below as APG 425, was an aqueous solution having 48 to 52% water and the remainder alkylpolyglycosides based on a C8-C14 natural fatty alcohols. Each formula was tested by mixing the final formula with 20 parts water and adding 1 oz of the diluted mixture to 4 oz of red cranapple juice. For the formula to pass the test, the juice must break down to a gray color within 3 seconds. Results for the various formulations are shown in the table below.

Results of Cleaning Composition Tests

| | | | Test Results |
|---|---|---|---|
| Formula 1 | APG 215 | 50 parts | Failed |
| | APG 425 | 50 parts | |
| | Methyl Soyate | 5 parts | |
| Formula 2 | APG 215 | 50 parts | Failed |
| | APG 425 | 50 parts | |
| | Methyl Soyate | 10 parts | |
| Formula 3 | APG 215 | 50 parts | Passed |
| | APG 425 | 50 parts | |
| | Methyl Soyate | 10 parts | |
| | Water | 10 parts | |
| | Sodium Hydroxide | 5 parts | |
| Formula 4 | APG 215 | 50 parts | Failed |
| | APG 425 | 50 parts | |
| | Methyl Soyate | 10 parts | |
| | Water | 10 parts | |
| | Sodium Carbonate | 5 parts | |
| Formula 5 | APG 215 | 50 parts | Passed |
| | APG 425 | 50 parts | |
| | Methyl Soyate | 10 parts | |
| | Water | 20 parts | |
| | Sodium Carbonate | 10 parts | |
| Formula 6 | APG 215 | 50 parts | Passed |
| | APG 425 | 50 parts | |
| | Methyl Soyate | 5 parts | |
| | Water | 20 parts | |
| | Sodium Carbonate | 10 parts | |
| Formula 7 | APG 215 | 50 parts | Failed |
| | APG 425 | 50 parts | |
| | Methyl Soyate | 5 parts | |
| | Water | 20 parts | |
| | Sodium Bicarbonate | 10 parts | |
| Formula 8 | APG 215 | 50 parts | Failed |
| | APG 425 | 50 parts | |
| | Methyl Soyate | 5 parts | |
| | Water | 20 parts | |
| | Sodium Chlorite | 10 parts | |

The data show the excellent cleaning performance obtainable with an alkyl polyglycoside combined with an alkylated vegetable oil and a sodium-containing base. The data also demonstrate show how the sodium-containing base (such as sodium carbonate and sodium hydroxide) significantly improves the cleaning performance of the cleaning composition. In addition, the data show that the required quantity of alkylated vegetable oil can be significantly reduced by using sufficient quantities of the sodium-containing base.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished without departing from the scope of the inventive concepts disclosed herein and defined by the appended claims.

What is claimed is:

1. A liquid cleaning composition, comprising:

a surfactant system, wherein the surfactant system comprises a mixture of: (a) a first alkyl polyglycoside, wherein the first alkyl polyglycoside comprises an alkyl chain length ranging from 8 to 10 carbon atoms; and (b) a second alkyl polyglycoside, wherein the second alkyl polyglycoside comprises an alkyl chain length ranging from 12 to 14 carbon atoms;

at least one alkyl ester derived from vegetable oil;

a base;

water; and wherein the weight ratio of the at least one alkyl ester derived from vegetable oil to the surfactant system ranges from approximately 3:100 to approximately 33:100.

2. A liquid cleaning composition, comprising:

a surfactant system, wherein the surfactant system comprises a mixture of: (a) a first alkyl polyglycoside, wherein the first alkyl polyglycoside comprises an alkyl chain length ranging from 8 to 10 carbon atoms; and (b) a second alkyl polyglycoside, wherein the second alkyl polyglycoside comprises an alkyl chain length ranging from 12 to 14 carbon atoms;

at least one alkyl ester derived from vegetable oil;

a base; and water.

3. The liquid cleaning composition according to claim 2, further comprising at least one ingredient selected from the group consisting of bleaching agents, bleach activators, builders, colorants, brighteners, pigments, perfumes, dyes, and combinations thereof.

4. The liquid cleaning composition according to claim 3, wherein the first and second alkyl polyglycosides have a degree of polymerization ranging from 1 to approximately 5.

5. The liquid cleaning composition according to claim 4, wherein the weight ratio of the at least one alkyl ester derived from vegetable oil to the surfactant system ranges from approximately 3:100 to approximately 33:100.

6. The liquid cleaning composition according to claim 5, wherein the at least one alkyl ester derived from vegetable oil comprises an alkyl soyate.

7. The liquid cleaning composition according to claim 6, wherein the at least one alkyl ester derived from vegetable oil is selected from the group consisting of methyl soyate, ethyl soyate and propyl soyate.

8. The liquid cleaning composition according to claim 7, wherein the at least one alkyl ester derived from vegetable oil comprises methyl soyate.

9. The liquid cleaning composition according to claim 8, wherein the base comprises at least one of a carbonate and a hydroxide.

10. A liquid cleaning composition, comprising:

(a) from approximately 20% to approximately 60% by weight a surfactant system, wherein the surfactant system comprises a mixture of: (a) a first alkyl polyglycoside, wherein the first alkyl polyglycoside comprises an alkyl chain length ranging from 8 to 10 carbon atoms; and (b) a second alkyl polyglycoside, wherein the second alkyl polyglycoside comprises an alkyl chain length ranging from 12 to 14 carbon atoms;

(b) from 1% to approximately 15% by weight alkyl esters derived from vegetable oil;

(c) from 1% to approximately 15% by weight a hydroxide, a carbonate, or mixtures thereof; and (d) the balance water and one or more ingredients selected from the group consisting of bleaching agents, bleach activators, builders, colorants, brighteners, pigments, perfumes, and dyes.

11. The liquid cleaning composition according to claim 10, wherein the first and second alkyl polyglycosides comprise alkyl polyglucosides.

12. The liquid cleaning composition according to claim 10, wherein the vegetable oil comprises soy bean oil.

13. The liquid cleaning composition according to claim 10, wherein the base comprises sodium carbonate.

14. A process for making a liquid cleaning composition, the process comprising:

preparing an alkaline aqueous solution comprising water and a sodium-containing base; and mixing the alkaline aqueous solution with at least one alkyl polyglycoside, at least one alkyl ester derived from a vegetable oil, and at least one adjunct ingredient such that the resulting liquid cleaning composition consists of 20% to 60% by weight alkyl polyglycosides, 1% to 15% by weight alkyl esters derived from vegetable oil, 1% to 15% by weight sodium-containing base, and the balance water and one or more adjunct ingredients selected from the group consisting of bleaching agents, bleach activators, builders, colorants, brighteners, pigments, perfumes, and dyes.

15. The process of claim 14, wherein the sodium-containing base comprises sodium carbonate.

16. The process of claim 14, wherein the at least one alkyl polyglycoside comprises at least one short chain alkyl polyglucoside having a chain length of from 8 to 10 carbon atoms, and at least one long chain alkyl polyglucoside having a chain length of from 12 to 14 carbon atoms.

17. The process of claim 14, wherein the alkyl ester derived from vegetable oil comprises an alkyl soyate.

18. The process of claim 14, wherein the alkyl ester derived from vegetable oil comprises methyl soyate, and the sodium-containing base comprises sodium carbonate.

* * * * *